United States Patent [19]

Chen

[11] Patent Number: 4,792,086

[45] Date of Patent: Dec. 20, 1988

[54] FOLDABLE CARDBOARD CUP

[76] Inventor: Gwo-Cherng Chen, 35-43, An Hsi Li, Chia Li Chen, Tainan Hsien, Taiwan

[21] Appl. No.: 90,882

[22] Filed: Aug. 31, 1987

[51] Int. Cl.[4] ..... B65D 3/28

[52] U.S. Cl. ..... 229/117; 229/41 R; 229/1.5 B

[58] Field of Search ..... 229/41 R, 41 B, 1.5 B, 229/104, 117

[56] References Cited

U.S. PATENT DOCUMENTS

| | | | |
|---|---|---|---|
| Re. 20,235 | 1/1937 | Boothby et al. | 229/41 R |
| 756,311 | 4/1904 | Adams | 229/41 R |
| 1,380,880 | 6/1921 | Austin | 229/41 B |
| 1,738,779 | 12/1929 | Lockwood | 229/1.5 B |
| 1,902,072 | 3/1933 | Harrod | 229/41 R |
| 2,006,952 | 7/1935 | Klein | 229/41 R |
| 3,108,730 | 10/1963 | Reinsberg | 229/41 R |

FOREIGN PATENT DOCUMENTS

| | | | |
|---|---|---|---|
| 344 | 8/1915 | United Kingdom | 229/1.5 B |

*Primary Examiner*—Stephen Marcus
*Assistant Examiner*—Gary E. Elkins
*Attorney, Agent, or Firm*—Varndell Legal Group

[57] ABSTRACT

This invention provides a foldable cardboard cup, especially one which comprises a conical wall having two symmetrical angular parts tapering to the bottom so that it can be folded into a rectangular piece, and a base having two symmetrical angular parts to facilitate the folding of the angular parts of the conical wall, and two inverted V-shaped parts formed from the apex of the conical base so that after being unfolded, the cup can stand in a fixed form without fear of returning to its original (folded) form when in use.

1 Claim, 4 Drawing Sheets

FOLDABLE CARDBOARD CUP

BACKGROUND AND SUMMARY OF THE INVENTION

Cups were used when human civilization began to develop or even earlier than that. In the early stage containers were made of stone, gourd, etc. Since ceramic containers were developed, a variety of fine ceramic and glass cups have been available. But as time progressed, people's requirements in sanitation have become more strict and social activities such as outing, dinner party, etc., have increased. Ceramic and glass cups can not satisfy the need of modern life, because they are breakable and inconvenient to carry. Therefore, cardboard cups were developed. These cups were disposable and easy to carry without fear of breakage. However, they have fixed forms and waste space when they are stored and transported. In order to eliminate these disadvantages, the present invention was developed.

DETAILED DESCRIPTION OF THE PREFERRED EMBODIMENT

Figure 2:
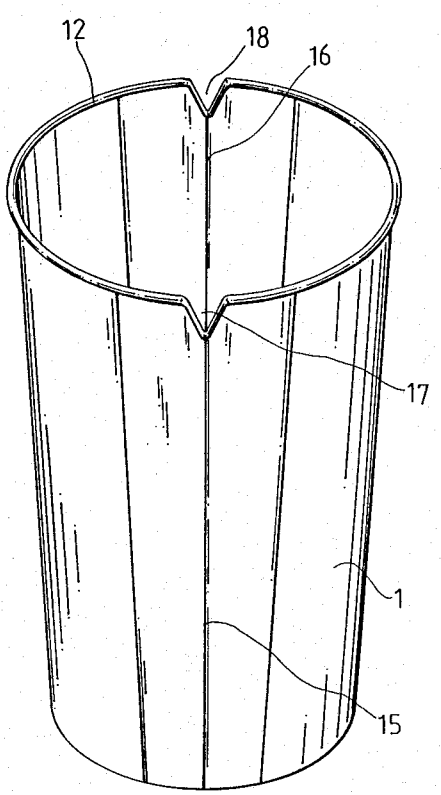
FIG. 2 is a vertical view of the said cup when it is unfolded.
Figure 1:
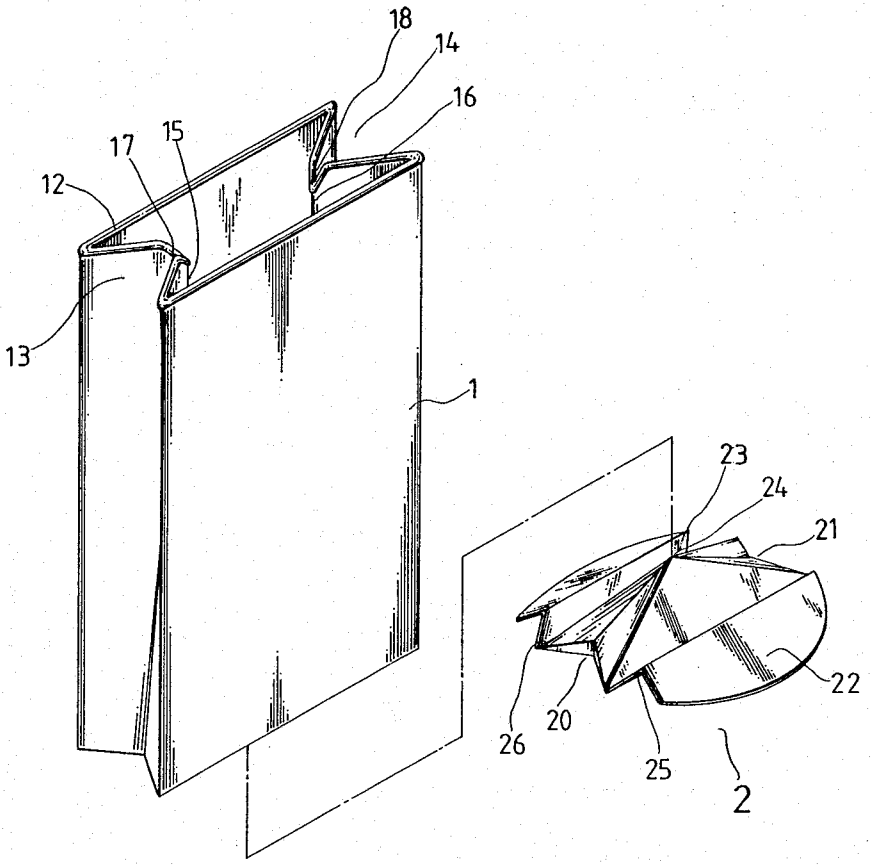
FIG. 1 is an exploded view of the foldable cardboard cup of this invention when it is folded.
Figure 4:
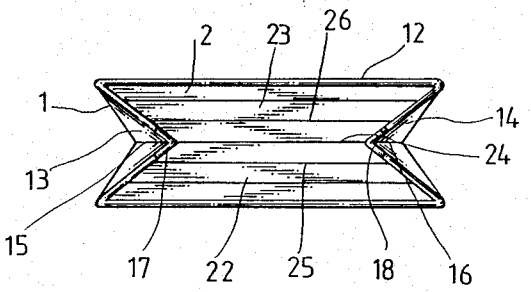
FIG. 4 is a top view of the cup as shown in FIG. 1.
Figure 5:
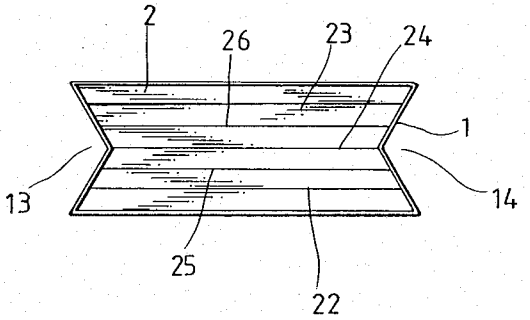
FIG. 5 is a bottom view of the cup as shown in FIG. 1.
Figure 3:
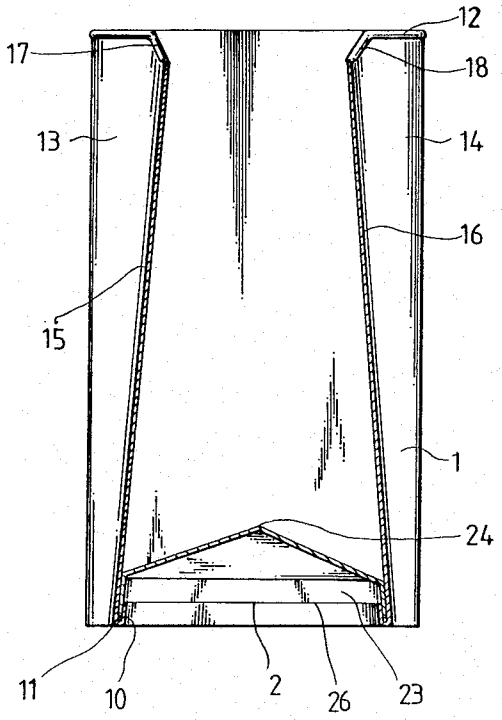
FIG. 3 is a side elevation of the cup as shown in FIG. 1.
Figure 7:
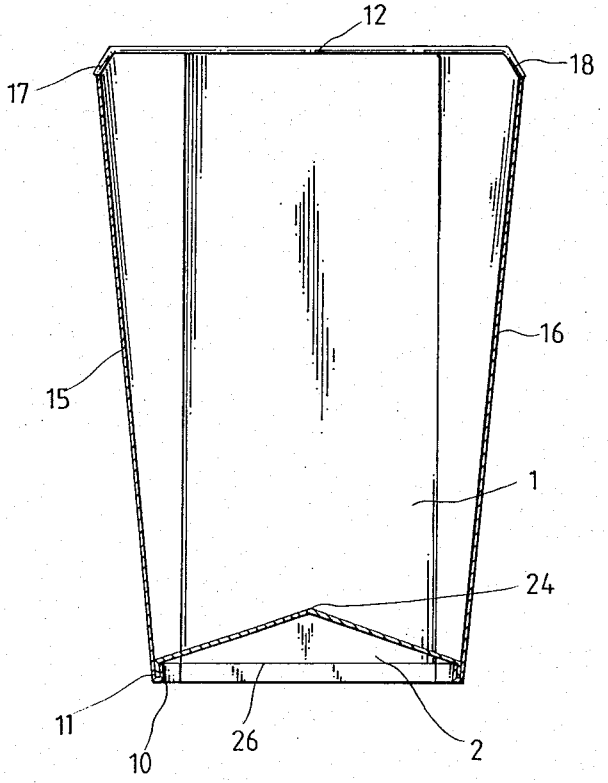
FIG. 7 is side elevation of the foldable cardboard cup of this invention when it is unfolded.
Figure 6:
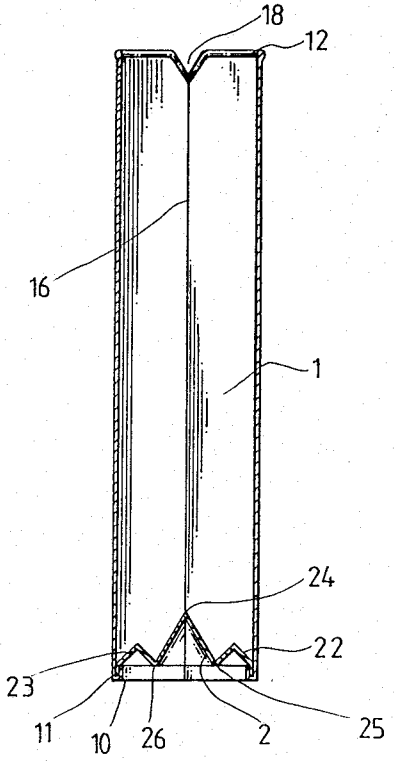
FIG. 6 is a front elevation of the cup as shown in FIG. 1.

FIGS. 1, 2, 3, 4, 5 and 6 show the construction of the foldable coardboard cup of this invention. The conical wall 1 of the cup has its bottom edge 10 folded up to form a circular groove 11 and its top edge made into a projecting rim 12 as shown in FIG. 3. Two symmetrical angular parts 13, 14 tapering to the bottom are formed by folding the opposite sides inward along the lines 15, 16. After being packed, the foldable cardboard cup of this invention becomes a flat rectangular piece as shown in FIG. 1. Two angular notches 17, 18 are provided at the top of the folding lines 15, 16 to prevent the rim from fracturing, when it is folded along the lines 15, 16 and to be used as a mouth. The base 2 has its edge fitted in the circular groove 11 and fixed therein as shown in FIG. 1. The base 2 also has two symmetrical angular parts 20, 21, as shown in FIG. 1 to facilitate the inward folding of the angular parts 13, 14 along the lines 15, 16. After being connected to the conical wall 1, the base 2 is in a form resembling a conical cap. From its apex 24, the base is folded into two inverted V-shaped parts 22, 23, as shown in FIGS. 6 and 7, with the bottom lines 25, 26 of the angular parts 20, 21 becoming the wave trough lines. Thus, the cup can be unfolded and maintain a fixed form which is firm enough to stand.

Figure 9:
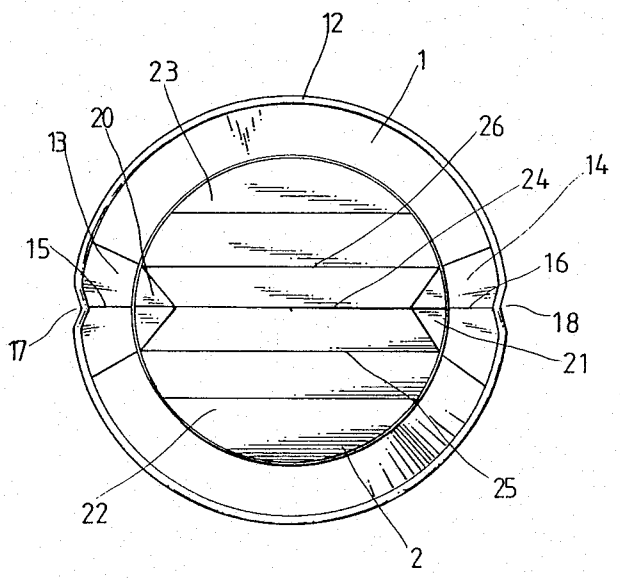
FIG. 9 is a bottom view of the unfolded cardboard cup.
Figure 8:
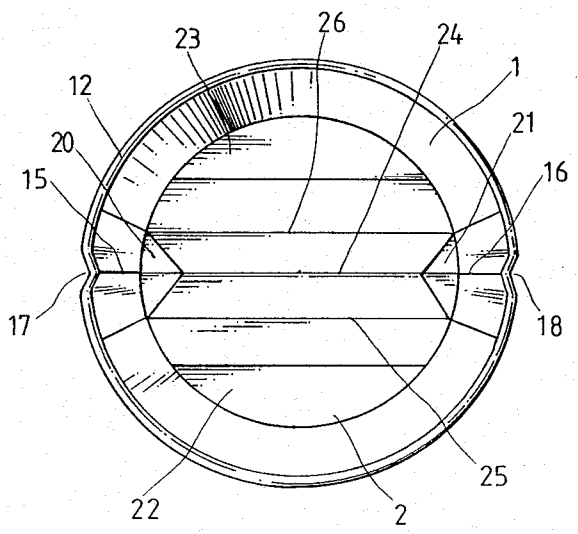
FIG. 8 is a top view of the unfolded cardboard cup.

FIGS. 7, 8 and 9 show the present invention after it is unfolded. Since the angular parts 13, 14 folded inward along the lines 15, 16 taper toward the bottom, it will become a conical wall 1 after being unfolded. Due to the angular notches 17, 18, the cup will not fracture along the lines 15, 16 when it is folded. When the cup is unfolded, the inverted V-shaped parts 22, 23 of the base 2 are flattened to increase the area of the base 2.

From the above, it is seen that the present invention is a new, practical design which will be advantageous in the packing and transporting industries though it is rather simple in art.

I claim:

1. A foldable cardboard cup comprising:

a wall having a top edge folded into a projecting rim, a bottom formed into a groove, two wall folding means for providing a flattened rectangular shape when the wall is folded and for providing a conical wall when the wall is unfolded, and notch means for preventing fracture of the wall when the wall is folded and for use as a mouth when the wall is unfolded, the two wall folding means having wall folding lines for providing a foldable wall portion, the foldable wall portion being tapered and extending from a wider portion at the top edge of the wall to a more narrow portion at the bottom of the wall, the two notch means being respectively arranged along the top edge of the wall at each of the two wall folding means, and a base having an edge fitted in the groove of the wall, the base having base folding means for providing a flattened base when the base is folded and for provided a conical base when the base is unfolded, the base folding means including two angular parts to facilitate folding of the wall foldable portion and folding lines capable of forming two inverted V-shaped parts when the base is folded, the base folding means cooperating with the wall folding means to provide a flatten rectangular shape when the wall and base are folded and to provide a conical cup when the wall and base are unfolded.

* * * * *